US011639641B2

(12) United States Patent
Stratton et al.

(10) Patent No.: US 11,639,641 B2
(45) Date of Patent: May 2, 2023

(54) DEGRADABLE IN-LINE BUOYANT SYSTEM FOR RUNNING CASING IN A WELLBORE

(71) Applicant: KLX Energy Services LLC, Houston, TX (US)

(72) Inventors: Robert Christopher Stratton, Tomball, TX (US); Michael Richard Dedman, Edgar, MT (US); Thomas Erle Larson, Berthoud, CO (US)

(73) Assignee: KLX ENERGY SERVICES, LLC, Houston, TX (US)

( * ) Notice: Subject to any disclaimer, the term of this patent is extended or adjusted under 35 U.S.C. 154(b) by 110 days.

(21) Appl. No.: 17/123,725

(22) Filed: Dec. 16, 2020

(65) Prior Publication Data

US 2021/0238942 A1 Aug. 5, 2021

Related U.S. Application Data

(60) Provisional application No. 62/949,246, filed on Dec. 17, 2019.

(51) Int. Cl.

| | |
|---|---|
| ***E21B 29/00*** | (2006.01) |
| ***E21B 33/12*** | (2006.01) |
| ***E21B 33/13*** | (2006.01) |

(52) U.S. Cl.

CPC ..... *E21B 29/00* (2013.01); *E21B 33/1208* (2013.01); *E21B 33/13* (2013.01); *E21B 2200/08* (2020.05)

(58) Field of Classification Search

CPC ..... E21B 29/00; E21B 33/1208; E21B 33/13; E21B 2200/08; E21B 33/134; E21B 43/10

See application file for complete search history.

(56) References Cited

U.S. PATENT DOCUMENTS

| | | | | |
|---|---|---|---|---|
| 4,907,649 | A * | 3/1990 | Bode | E21B 33/16 137/553 |
| 5,479,986 | A * | 1/1996 | Gano | E21B 23/04 166/292 |
| 6,026,903 | A * | 2/2000 | Shy | E21B 33/12 166/292 |
| 6,076,600 | A * | 6/2000 | Vick, Jr. | E21B 33/1208 166/376 |
| 7,513,311 | B2 * | 4/2009 | Gramstad | E21B 34/063 166/376 |
| 9,732,579 | B2 * | 8/2017 | Hiorth | E21B 33/12 |
| 11,149,522 | B2 * | 10/2021 | Brandsdal | E21B 34/063 |
| 11,313,199 | B2 * | 4/2022 | Saraya | E21B 33/1208 |
| 2002/0144813 | A1 * | 10/2002 | Allamon | E21B 43/10 166/291 |
| 2010/0270031 | A1 * | 10/2010 | Patel | E21B 33/1208 166/376 |

(Continued)

*Primary Examiner* — Steven A MacDonald

(74) *Attorney, Agent, or Firm* — McAfee & Taft

(57) ABSTRACT

A tool for running a casing string assembly into a wellbore includes a degradable plug assembly that temporarily isolates light fluid trapped in a lower portion of the casing string from heavier fluid in the upper portion of the casing string, thereby reducing the horizontal weight of the casing string by an amount sufficient to overcome a drag force. After the casing string is landed at a final location in the wellbore, fluid is introduced to the degradable plug assembly to degrade the plug and clear the axial passageway of the casing string so that tools or other equipment can pass therethrough.

24 Claims, 5 Drawing Sheets

(56) References Cited

U.S. PATENT DOCUMENTS

| | | | | |
|---|---|---|---|---|
| 2011/0042099 | A1* | 2/2011 | Williamson, Jr. | E21B 29/02 166/373 |
| 2014/0008085 | A1* | 1/2014 | Tinnen | E21B 34/063 166/134 |
| 2014/0174757 | A1* | 6/2014 | Fripp | E21B 33/1208 166/376 |
| 2014/0338923 | A1* | 11/2014 | Fripp | E21B 33/12 166/376 |
| 2016/0060998 | A1* | 3/2016 | Hiorth | E21B 33/1208 166/192 |
| 2016/0281455 | A1* | 9/2016 | Brandsdal | E21B 33/1208 |
| 2020/0131884 | A1* | 4/2020 | Saraya | E21B 34/06 |
| 2021/0017833 | A1* | 1/2021 | Saraya | E21B 34/14 |
| 2021/0140262 | A1* | 5/2021 | Yuan | E21B 33/12 |
| 2021/0148184 | A1* | 5/2021 | Helms | E21B 33/12 |

* cited by examiner

DEGRADABLE IN-LINE BUOYANT SYSTEM FOR RUNNING CASING IN A WELLBORE

CROSS-REFERENCE TO RELATED APPLICATIONS

This application claims priority to U.S. Provisional Patent Application No. 62/949,246 filed on Dec. 17, 2019, the entirety of which is hereby incorporated herein by reference in its entirety.

FIELD OF THE DISCLOSURE

The present disclosure relates generally to downhole equipment for hydrocarbon wells. More particularly, the present disclosure pertains to a method and apparatus for floating casing to depth in a wellbore.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, a casing is then lowered and set in place.

In many wells, it can be difficult to run the casing to great depths because friction between the casing and the wellbore during run-in often results in a substantial amount of drag. This is particularly true in horizontal and/or deviated wells, where, in some cases, the drag on the casing can exceed the available weight of the casing in the vertical section of the wellbore that would otherwise tend to progress the casing further along. If there is insufficient weight in the vertical portion of the wellbore, it can be difficult or impossible to overcome the drag in the wellbore, thus limiting the depth to which the casing can be run or preventing completion of a horizontal or deviated well.

BRIEF DESCRIPTION OF THE DRAWINGS

Certain embodiments of the invention are described with reference to the accompanying drawings, wherein like reference numerals denote like elements. It should be understood, however, that the accompanying drawings illustrate only the various implementations described herein and are not meant to limit the scope of various technologies described herein. Various embodiments of the current invention are shown and described in the accompanying drawings of which.

Figure 1:
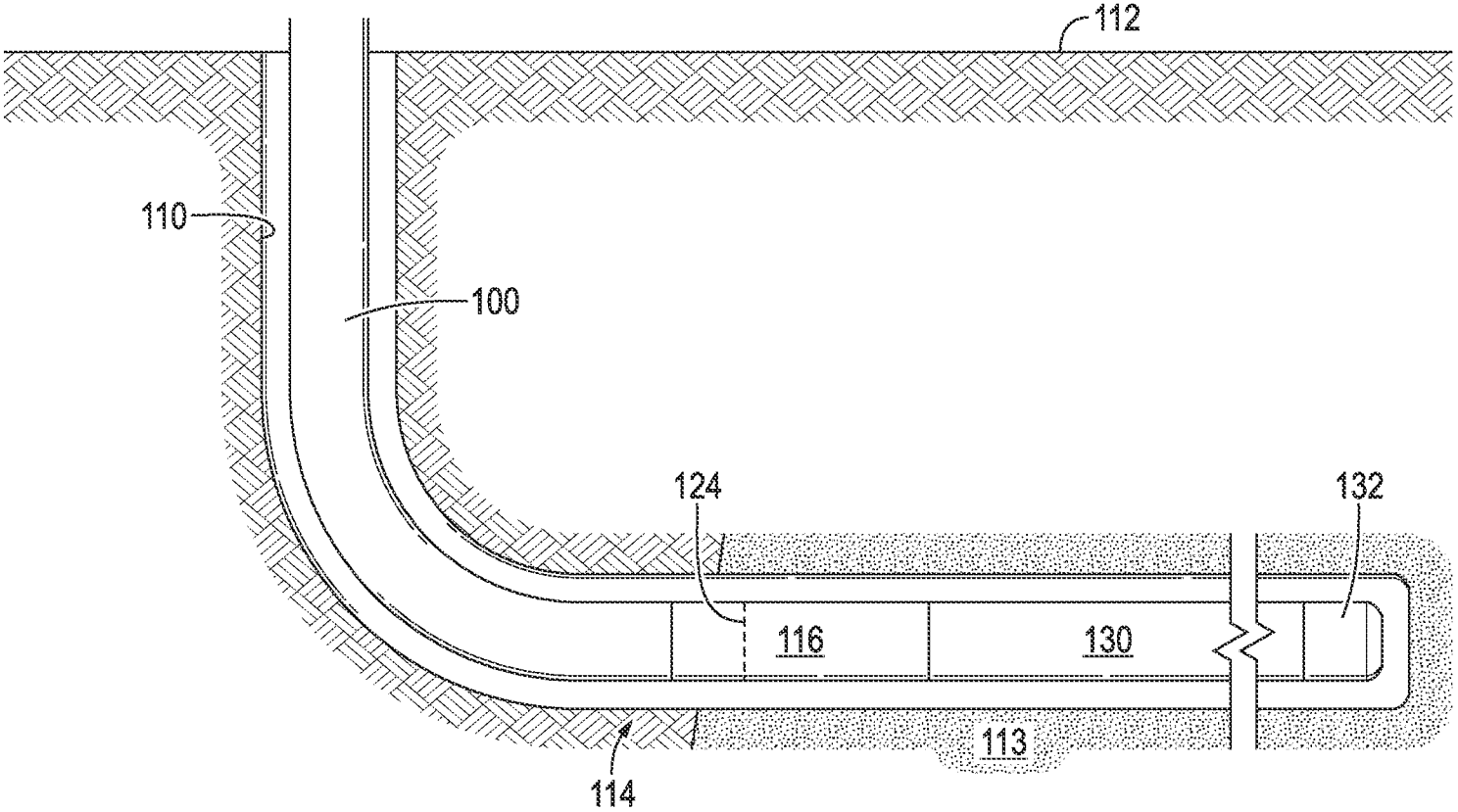
FIG. 1 schematically illustrates a casing string assembly, including a degradable plug assembly, being run into a non-vertical wellbore, according to an embodiment.

The headings provided herein are for convenience only and do not necessarily affect the scope or meaning of what is claimed in the present disclosure.

Embodiments of the present disclosure and their advantages are best understood by referring to the detailed description that follows. It should be appreciated that like reference numbers are used to identify like elements illustrated in one or more of the figures, wherein showings therein are for purposes of illustrating embodiments of the present disclosure and not for purposes of limiting the same.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

Certain terms are used throughout the following description to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion, the terms "including" and "comprising" are used in an open-ended fashion, and thus should be interpreted to mean "including, but not limited to." Also, the term "couple" or "couples" is intended to mean either an indirect or direct connection. Thus, if a first device couples to a second device, that connection may be through a direct connection, or through an indirect connection via other devices, components, and connections. Any reference to up or down in the description is made for purposes of clarity, with "up", "upper", "upwardly", or "upstream" meaning toward the surface of the borehole and with "down", "lower", "downwardly", "downhole", or "downstream" meaning toward the terminal end of the borehole, regardless of the borehole orientation.

Systems and techniques for lowering a casing or a liner (either referred to herein as casing) to a desired depth or location in a borehole that penetrates a hydrocarbon reservoir are well known. However, because friction between the casing and the borehole can create drag, running the casing to great depths or over extended horizontal distances can be challenging. In boreholes that are non-vertical, such as horizontal or deviated wellbores, the drag can present a large obstacle to completing the well. Various techniques have been developed to overcome this drag so that greater vertical well depths and greater non-vertical well lengths can be achieved. For instance, techniques to lighten or "float" the casing have been used to extend the depth or length of or to complete the well. For example, techniques are known in which the ends of a casing string portion are plugged and are filled with a low density, miscible fluid to provide a buoyant force. However, after the plugged portion is placed in the wellbore, the plug must be drilled out, and the low density miscible fluid is forced out into the wellbore.

According to other known techniques for floating casing, a rupture disc assembly is provided where, after the casing is installed in the wellbore, the rupture disc can be ruptured by engagement with an impact surface of a tube. However, engagement with the impact surface shatters the disc, resulting in shattered disc fragments that remain in the wellbore. These fragments can damage the casing string or tools lowered within the string as fluid circulates within the wellbore. Moreover, the inside diameter of the casing may be restricted following the rupture of the disc, which can later prevent or impede conveyance of downhole tools within the restricted region of the casing string so that further operations, such as cementing, cannot be readily performed using conventional techniques.

Embodiments disclosed herein are directed to devices and methods to float a casing string in a wellbore in order to extend the depth or non-vertical distance and that, when employed, do not introduce damaging debris or unduly restrict the inside diameter of the casing.

Referring now to FIG. 1, a casing string assembly 100 that is being deployed in a wellbore 110 is schematically shown. The wellbore 110 has been drilled through an earth surface 112 and penetrates a region of interest 113 (e.g., a hydrocarbon reservoir). As shown, the wellbore 110 includes a non-vertical or deviated section 114. Within the section 114, the casing string assembly 100 includes a tool 116 with a degradable plug assembly 124 to assist with running the casing string assembly 100 to the desired location or depth in the wellbore 100. As will be described in further detail below, during run-in of the casing string 100, the tool 116 is in a closed state in which fluid communication between upper and lower sections of the tool 116 is blocked. Once the string 100 is landed at a final desired location in the wellbore 110, the tool 116 is transitioned to an open state in which fluid communication between the upper and lower sections is allowed.

The casing string assembly 100 also includes a fluid blocking device 132 located in a lower portion of the casing string 100, such as at or near the terminal end of the string 100. In embodiments, the blocking device 132 can be located one or more thousands of feet from the tool 116. The blocking device 132 prevents drilling fluids or other wellbore fluids from entering the casing string assembly 100 as it is being run into the wellbore 100. As such, when the tool 116 is added to the string 100 and is in its closed state, the blocking device 132 and tool 116 operate in conjunction to form a buoyant chamber 130 in the lower portion of the casing string assembly 100 in which a light fluid (e.g., air, gas or other lightweight fluid) is trapped, as will be further described below. In embodiments, the blocking device 132 can be a temporary plug that is removed after the casing 100 is positioned at the desired final location. Or, the device 132 can be a one-way float valve that prevents fluid from entering the casing string 100, but allows fluid to be pumped through the string 100 during circulation and/or cementing after the tool 116 has been converted to its open state.

Figure 2A:
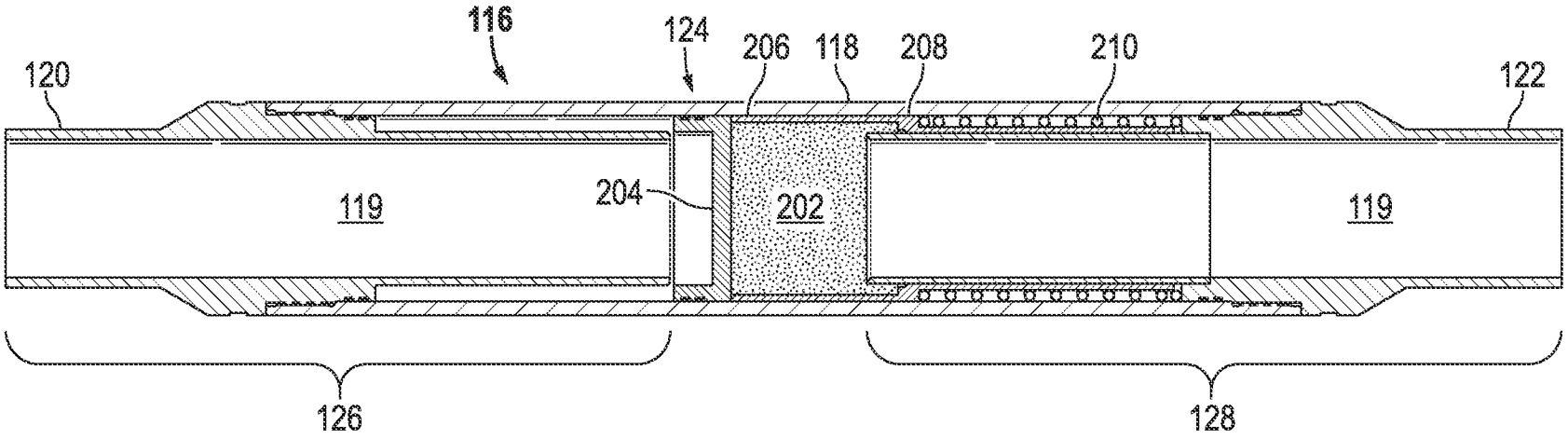
FIGS. 2A and 2B are cross-sectional views of a tool with a degradable plug assembly when in a closed state and an open state, respectively, according to an embodiment.
Figure 2B:
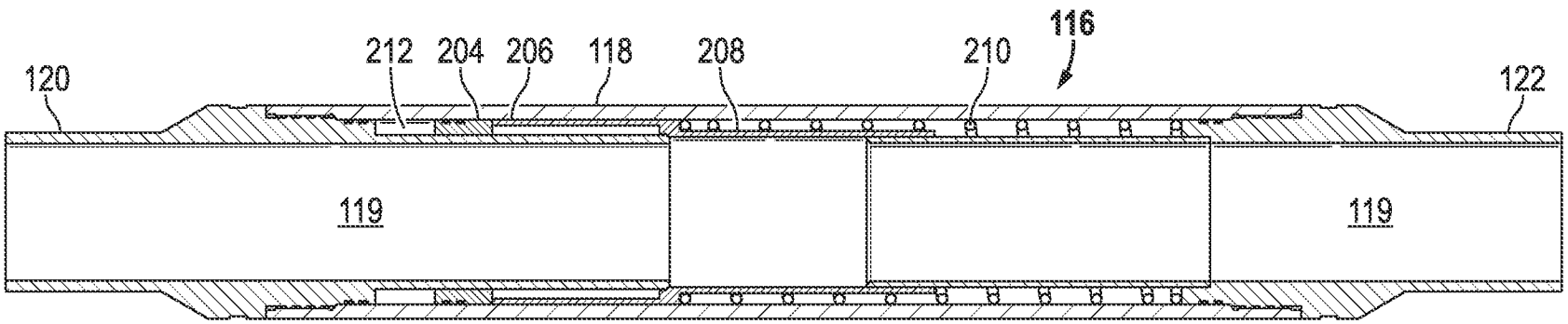

FIGS. 2A and 2B show cross-sectional views of an embodiment of the tool 116 that, in FIG. 1, is positioned in the non-vertical portion 114 of the wellbore 110. In this embodiment, tool 116 includes a cylindrical housing 118 defining an internal fluid passageway 119 that extends between first and second ends 120, 122. Ends 120 and 122 are configured so that the tool 116 can be connected within the casing string assembly 100, such as by a threaded connection. For ease of reference, end 120 will be referred to as the "upper" end and end 122 will be referred to as the "lower" end. In this context, when the tool 116 is assembled within the casing string 100 and run into the wellbore 110, the upper end 120 is the end closer to the surface 112 and the lower end 122 is the end closer to the terminal end of the wellbore 110.

Tool 116 can be converted between an initial closed state (shown in FIG. 2A) and a final open state (shown in FIG. 2B). In the closed state, a degradable plug assembly 124 temporarily provides for fluid isolation between an upper section 126 and a lower section 128 of the internal passageway of the tool 116. In the embodiment shown, the degradable plug assembly 124 includes a degradable plug portion 202 and an upper cover 204. The degradable plug portion 202 can be a composite of sand with a degradable material, such as sugar and/or salt, but can be made of other degradable materials that degrade, deteriorate and/or dissolve upon exposure to a fluid (e.g., water, well fluid, or other substance present in the wellbore). In embodiments, plug portion 202 can be made of a compressed degradable material (e.g., salt) that is formed in a shape that substantially fills the inner passageway 119. In other embodiments, plug portion 202 can be non-compressed degradable material that is contained within a container that includes the upper cover 204 and a lower cover. In embodiments, the upper cover 204 and/or lower cover (if used) can be discs made of a material that can be ruptured, bent or easily moved within the axial passageway of the tool 116, such as a metal or a ceramic. Or, the upper cover 204 can be made of a ceramic or a metal material and the lower cover can be made of a compressed degradable material, as examples.

Returning to the embodiment shown in FIGS. 2A and 2B, upper cover 204 is movable within the axial inner passageway 119. In the embodiment shown, fluid pressure applied from the surface 112 holds the upper cover 204 against the degradable plug portion 202 and an end portion 206 of a spring-loaded slidable sleeve 208. In the closed state of the tool 116, the fluid pressure is sufficiently high to press the upper cover 204 against the plug portion 202 and the end portion 206 so that the spring 210 is in a biased state. To place the tool 116 in an open state, fluid pressure is decreased sufficiently to allow the spring 210 to release and move the slidable sleeve 208 upwards in the axial passageway 119, thus pushing the cover 204 in the upwards direction. Movement of the cover 204 results in rupture of the cover 204. For example, the cover 204 can be moved so that it impacts a structure that ruptures the cover. Alternatively, upward movement of the cover 204 can create a pocket beneath the cover 204 into which fluid can enter. Fluid pressure in the pocket then increases until the cover 204 bursts.

Regardless of how the cover 204 is ruptured, fluid is introduced to the degradable plug portion 202. In embodiments, the fluid washes away the material of the plug portion 202 so that it exits the end of the string 100 into the wellbore 110. In other embodiments, the fluid degrades or dissolves the material of the plug portion 202, thereby opening the axial passageway 119 to fluid flow or the introduction of equipment or tools.

In embodiments, once the upper cover 204 has ruptured, the movable sleeve 208 continues to move the upper cover 204 so that the fragmented portions of the cover 204 are contained within compartments 212 along the sidewall of the axial passageway 119. Containment of the portions of the upper cover 204 within compartments 212 helps ensure that the axial passageway 119 is not obstructed and that sharp fragments of the cover 204 do not interfere with or damage equipment or tools that later may be directed through the axial passageway 119.

Figure 3A:
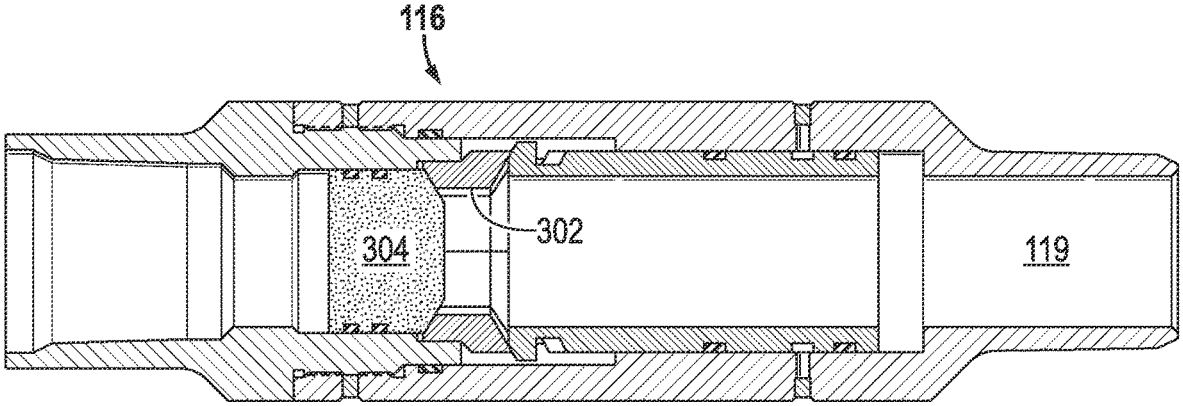
FIGS. 3A and 3B are cross-sectional views of a tool with a degradable plug assembly when in a closed state and an open state, respectively, according to an embodiment.
Figure 3B:
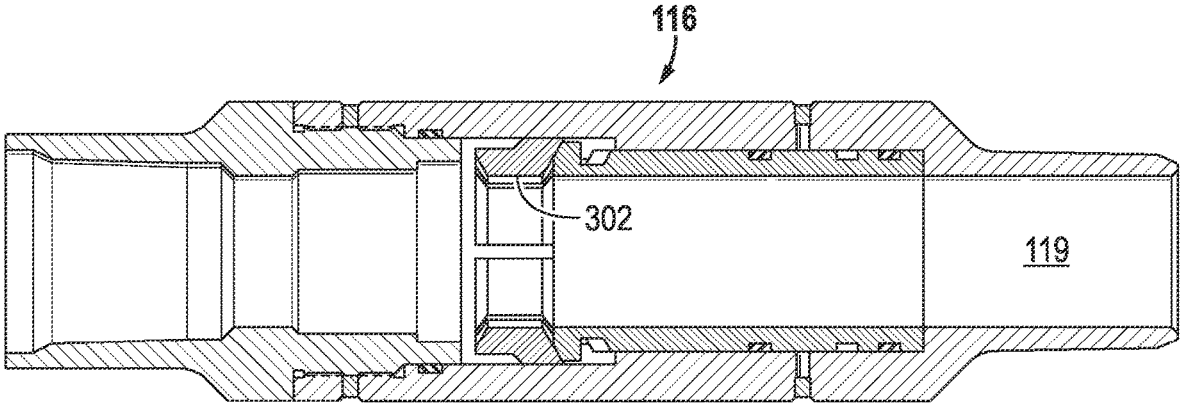

Another embodiment of the tool 116 is shown in cross-section in FIGS. 3A (closed state) and 3B (open state). This embodiment employs an expanding seat configuration. In FIG. 3A, a seat 302 is in the unexpanded state, preventing the degradable plug portion 304 from passing through the axial passageway 119. In FIG. 3B, the pressure is increased in the upper portion of the passageway 119 so that the eat 302 expands. The debris from the degradable plug portion 304 can then exit the end of the string 100, thereby opening the axial passageway 119.

Figure 4A:
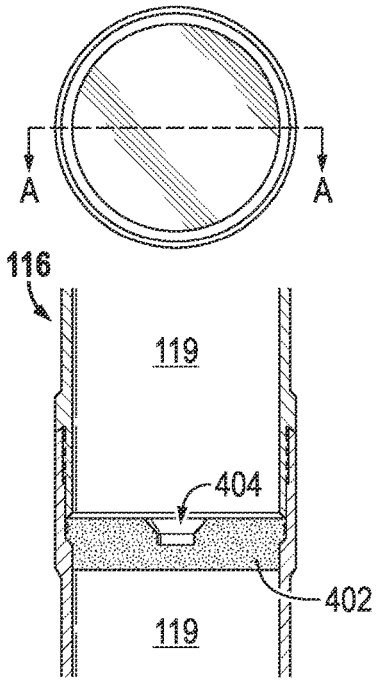
FIGS. 4A, 4B, 4C, 4D and 4E are cross-sectional views of a degradable plug assembly, according to an embodiment.
Figure 4B:
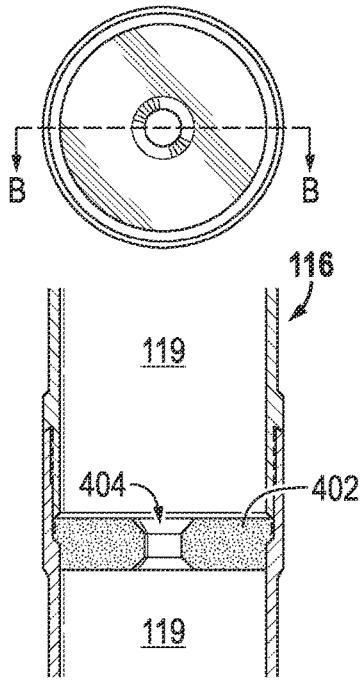
Figure 4C:
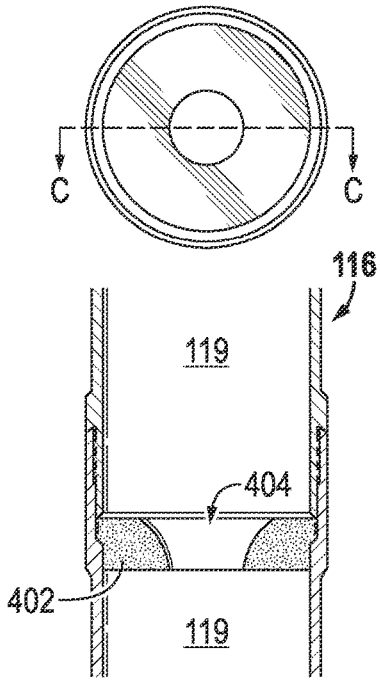
Figure 4D:
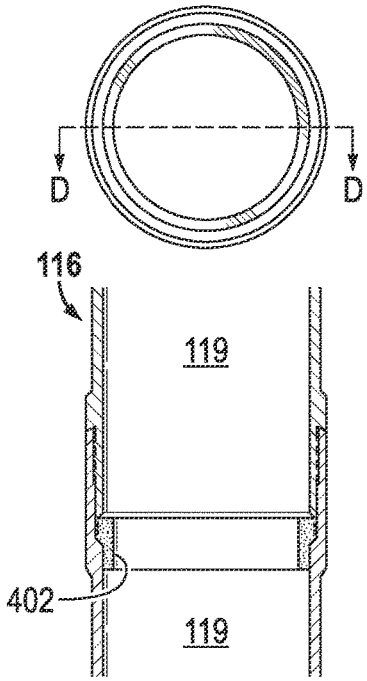
Figure 4E:
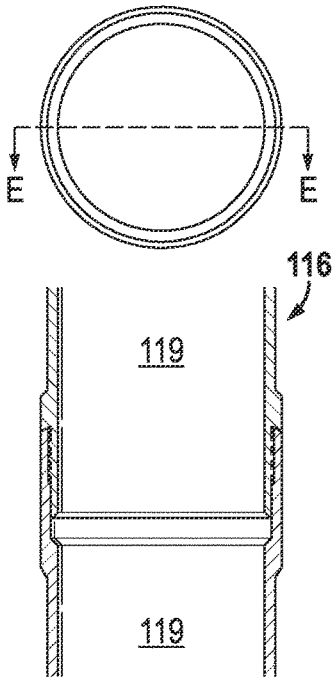

Another embodiment of the tool 116 is shown in cross-section in FIGS. 4A-4E. In this configuration, a plug 402 is made of a compressed degradable material and is shaped to fit within the axial passageway 119. The plug 402 includes a funnel-shaped recess 404 in which fluid can be introduced. The plug 402 with funnel 404 are configured so that, over time, the fluid in the passageway 119 erodes the degradable material until the passageway 119 is opened, as shown in the series of FIGS. 4A (closed)-4E (open).

Figure 5:
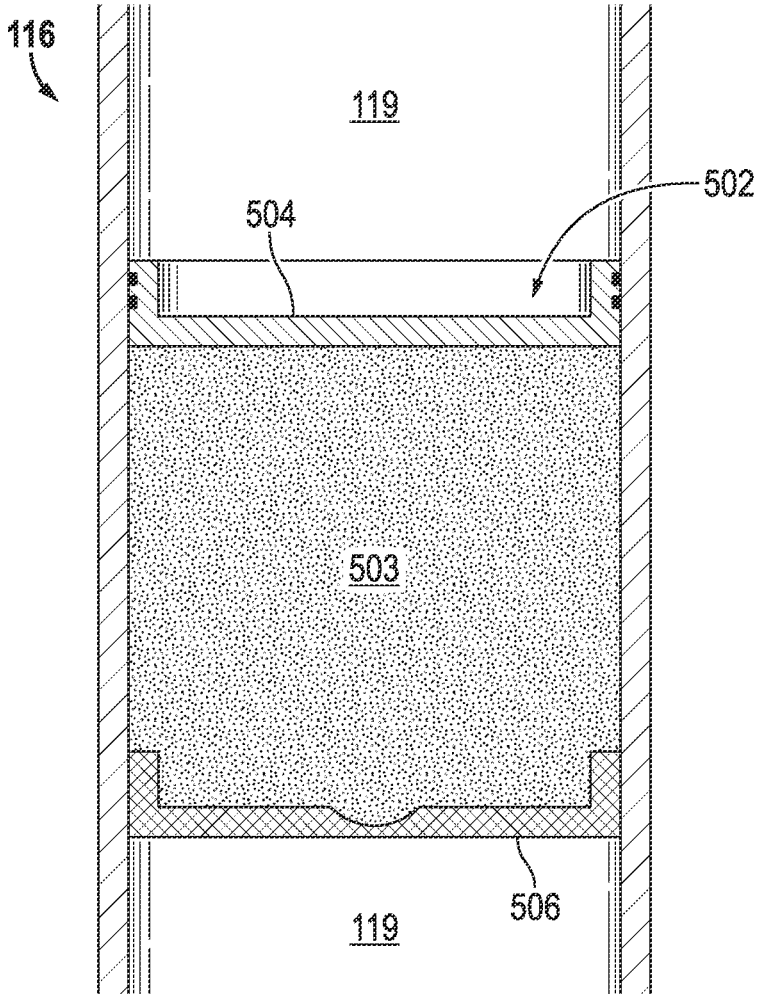
FIG. 5 is a cross-sectional view of a degradable plug assembly, according to an embodiment.

Another embodiment of a degradable plug assembly 502 that can be used in the tool 116 is shown in cross-section in FIG. 5. In this embodiment, degradable material 503 (in a non-compressed form) is contained in the axial passageway 119 between an upper cover 504 and a lower cover 506. When the tool 116 is in the closed state, fluid pressure applied from the surface 112 holds the upper cover 504 against the degradable material 503. When the pressure is decreased, the upper cover 504 can rise, creating a pocket thereunder in which fluid is introduced. The upper cover 504 then bursts. The lower cover 506 is made of a thin material, which may be a thin metal that is readily burst or which may be a compressed degradable material that eventually degrades or dissolves. In either case, the lower cover 506 falls through the passageway and exits the string 100 along with any debris from the degradable plug portion 503. The axial passageway 119 is then open to fluid flow and/or the introduction of other equipment or tools that are run through the string 119.

In an embodiment, the upper cover 504 can be a non-fragmenting rupture disc so that, when ruptured, the cover 504 does not shatter into fragments that later can restrict the inside diameter of the tool 116 or present sharp edges or shards that can damage equipment or tools that later are run through the casing string 100. In other embodiments, the upper cover 504 be a movable barrier that can be contained within protective regions within the casing string so as not to impede the passageway 119 (as shown, for example, in the embodiment of FIG. 2B) when other tools or equipment are run through the string 100, such as during a cementing operation.

According to an embodiment, the tool 116 is connected within the casing string 100 so as to maximize vertical weight on the casing string 100, while minimizing horizontal weight. To that end, in an embodiment, the plug assembly 124 traps air and/or other low weight fluid in the lower tool portion 128 (and lower portion of the casing string 100) and isolates the lower portion 128 from heavier fluid in the upper portion 126 of the tool 116 (and the upper portion of the casing string 100 and wellbore 110). In operation, when the tool 116 is in the closed state, the plug assembly 124 isolates the upper portion 126 of the fluid passageway (which is filled with a heavier fluid) from the buoyant chamber 130 in the passageway that extends between the plug assembly 124 and the fluid blocking device 132 (which contains a lighter weight fluid). As an example, heavier fluid in the upper portion 126 can be drilling mud, and the lighter weight fluid in the buoyant chamber 132 can be air, nitrogen, carbon dioxide, oil and/or other lightweight or miscible fluid. As will be appreciated by persons skilled in the art, this configuration reduces weight of the casing string 100 and consequently the drag and frictional force acting on the casing string 100 in accordance with Archimedes' Principle.

In an embodiment, the casing string 100 is run into the wellbore 110 for a desired initial distance using a conventional technique. The fluid blocking device 132 at the end of the string 100 prevents fluids in the wellbore 110 from entering the casing 100. Once the desired initial distance is reached, the tool 116 is added to the casing string 100, e.g., by threadedly coupling the ends 120 and 122 of the tool 116 to casing string 100 subs. When the tool 116 is added to the string 100, the plug assembly 124 is in the closed state in which it blocks the internal passageway of the tool 116 and, thus, fluidly isolates the upper section 126 from the lower section 128. In the closed state, air, gas and/or other light weight fluid are trapped in the buoyant chamber 130. Heavier fluid, such as drilling mud, is then provided above the isolation barrier 124 to continue the run-in of string 100 in the wellbore 110.

The distance that the casing string 100 is run before adding the tool 116 depends on the configuration of the particular wellbore 110. In general, the tool 116 is added at a location within the casing string 100 to create buoyancy so that the casing string 100 can be run in non-vertical or deviated sections of the wellbore 110 without generating a drag force that is great enough to prevent the string 100 from reaching its final desired location. To that end, the tool 116 is positioned at a location within the casing string 100 to assist in overcoming the drag forces on the casing string 100, thereby allowing the casing string to be positioned at greater depths or extended to greater non-vertical distances.

Once the casing string 100 has been run and landed at the final desired location in the wellbore 110, the plug assembly 124 is transitioned to the open state in which fluid communication is provided between the upper section 126 of the passageway and the buoyant chamber 130. Different techniques and structures for transitioning the plug assembly 124 to the open state have been discussed above.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. Descriptions of features or aspects within each embodiment should typically be considered as available for other similar features or aspects in other embodiments unless stated otherwise. The terminology used herein is for the purpose of describing the particular embodiments and is not intended to be limiting of exemplary embodiments of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the scope of the invention as defined by the following claims. Therefore, the scope of the invention is not confined by the detailed description of the invention but is defined by the following claims.

What is claimed is:

1. A tool for running a casing string in a wellbore, comprising:

a cylindrical housing having an inside diameter that defines a fluid passageway extending between first and second ends of the housing, the first and second ends configured to connect the housing within a casing string;

a degradable plug assembly disposed within the cylindrical housing and having a closed state and an open state, wherein, in the closed state, the degradable plug assembly blocks the inside diameter to fluidly isolate an upper portion of the passageway from a lower portion of the passageway, and wherein, in the open state, the degradable plug assembly allows for fluid communication through the fluid passageway, wherein the degradable plug assembly includes a degradable plug; and an upper cover movable within the fluid passageway between a closed state and an open state, wherein, in the closed state, the upper cover is held against the degradable plug and blocks fluid communication to the degradable plug and thus prevents the degradable plug assembly from changing from the closed state to the open state, and wherein, when the upper cover is moved to the open state, the upper cover moves away from the disposable plug and fluid communication is allowed to the degradable plug, and the degradable plug is configured such that the fluid communication changes the degradable plug assembly to the open state.

2. The tool as recited in claim 1, wherein the degradable plug is made of a composite comprising sand.

3. The tool as recited in claim 1, wherein the degradable plug comprises a material dissolvable in a fluid.

4. The tool as recited in claim 3, wherein the material dissolvable in the fluid is compressed.

5. The tool as recited in claim 1, wherein the degradable plug is made of a material comprising salt.

6. The tool as recited in claim 1, wherein the tool is configured such that, a fluid pressure is applied from upstream, to maintain the upper cover in the closed state and held against the degradable plug, and the upper cover is moved to the open state by decreasing the fluid pressure such that the upper cover is no longer held against the degradable plug.

7. The tool as recited in claim 6, wherein the tool is configured such that, when the upper cover moves away from the disposable plug, the upper cover ruptures.

8. The tool as recited in claim 7, wherein the tool further includes a spring configured to upwardly bias the upper cover, such that, when the fluid pressure is decreased, the upper cover moves away from the degradable plug.

9. A method for running a casing string assembly into a wellbore, comprising:

connecting a tool within a casing string assembly, the tool comprising:

a cylindrical housing having a fluid passageway extending between an upper end and a lower end; and a degradable plug assembly disposed within the cylindrical housing and having a closed state and an open state, wherein, in the closed state, the degradable plug assembly blocks the inside diameter to fluidly isolate an upper portion of the passageway from a lower portion of the passageway, and wherein, in the open state, the degradable plug assembly allows for fluid communication through the fluid passageway, wherein the degradable plug assembly includes a degradable plug;

providing a fluid in an upper portion of the casing string assembly that is heavier than the light fluid trapped in the lower portion of the casing string assembly;

landing the casing string assembly at a desired location in a wellbore;

moving a cover within the fluid passageway to an open state, wherein the cover is movable within the fluid passageway between a closed state and an open state, wherein, in the closed state, the cover is held against the degradable plug and blocks communication of the fluid to the degradable plug, and wherein in the open state, the cover moves away from the disposable plug and fluid communication is allowed to the degradable plug; and the degradable plug is configured such that the fluid communication changes the degradable plug assembly to the open state; and after moving the cover to the open state, introducing fluid to the degradable plug assembly to place the degradable plug assembly in the open state by degrading the degradable plug.

10. The method as recited in claim 9, wherein the degradable plug is made of a composite comprising sand.

11. The method as recited in claim 9, wherein the degradable plug comprises a material dissolvable in the fluid.

12. The method as recited in claim 11, wherein the material dissolvable in the fluid is compressed.

13. The method as recited in claim 9, wherein the upper cover is maintained in the closed state and held against the degradable plug by a fluid pressure applied from upstream, and the step of moving the cover to an open state comprises reducing the fluid pressure such that the upper cover is no longer held against the degradable plug.

14. The method as recited in claim 13, wherein moving the cover within the passageway comprises rupturing the cover to provide for communication of the fluid to the degradable plug.

15. The method as recited in claim 14, wherein the degradable plug assembly comprises a spring configured to upwardly bias the cover, such that, during the reducing the fluid pressure, the upper cover moves away from the degradable plug.

16. A casing string assembly to deploy in a wellbore, comprising:

a casing string extending between a first end proximate a surface penetrated by the wellbore and a second terminal end;

a tool housing having an inside diameter that defines a fluid passageway extending between first and second ends of the housing, the first and second ends coupling the housing within the casing string at a location intermediate the first end and the second end;

a degradable plug assembly disposed within the tool housing and having a closed state and an open state, wherein, in the closed state, the degradable plug assembly blocks the inside diameter to fluidly isolate an upper portion of the passageway from a lower portion of the passageway, and wherein, in the open state, the degradable plug assembly allows for communication of a fluid through the fluid passageway such that the fluid can be introduced from the surface into the casing string assembly at the first end and communicated to the second end, and wherein the degradable plug assembly comprises;

a degradable plug; and an upper cover movable within the fluid passageway between a closed state and an open state, wherein, in the closed state, the upper cover is held against the degradable plug and blocks fluid communication to the degradable plug and thus prevents the degradable plug assembly from changing from the closed state to the open state, and wherein, when the upper cover is moved to the open state, the upper cover moves away from the disposable plug and fluid communication is allowed to the degradable plug, and the degradable plug is configured such that the fluid communication changes the degradable plug assembly to the open state; and a fluid blocking device coupled with the casing string at a location intermediate the second terminal end and the degradable plug assembly to define a sealed chamber therebetween, wherein the sealed chamber is configured to contain fluid.

17. The casing string assembly as recited in claim 16, wherein the fluid blocking device comprises a plug.

18. The casing string assembly as recited in claim 16, wherein the degradable plug is made of a composite comprising sand.

19. The casing string assembly as recited in claim 16, wherein the degradable plug comprises a material dissolvable in the fluid.

20. The casing string assembly as recited in claim 19, wherein the material dissolvable in the fluid is compressed.

21. The casing string assembly as recited in claim 16, wherein the degradable plug is made of a material comprising salt.

22. The casing string assembly as recited in claim 16, wherein the degradable plug assembly is configured such that a fluid pressure is applied from upstream to maintain the upper cover in the closed state and held against the degradable plug, and the upper cover is moved to the open state by decreasing the fluid pressure such that the upper cover is no longer held against the degradable plug.

23. The casing string assembly as recited in claim 22, wherein the degradable plug assembly is configured such that, when the upper cover moves away from the disposable plug, the upper cover ruptures.

24. The casing string assembly as recited in claim 23, wherein the degradable plug assembly further includes a spring configured to upwardly bias the upper cover, such that when the fluid pressure is decreased, the upper cover moves away from the degradable plug.

* * * * *